US006786852B2

(12) United States Patent
Watterson et al.

(10) Patent No.: US 6,786,852 B2
(45) Date of Patent: Sep. 7, 2004

(54) TREADMILL DECK WITH CUSHIONED SIDES

(75) Inventors: Scott R. Watterson, Logan, UT (US); Greg Law, Smithfield, UT (US); Rick Hendricksen, River Heights, UT (US)

(73) Assignee: Icon IP, Inc., Logan, UT (US)

( * ) Notice: Subject to any disclaimer, the term of this patent is extended or adjusted under 35 U.S.C. 154(b) by 249 days.

(21) Appl. No.: 09/940,691

(22) Filed: Aug. 27, 2001

(65) Prior Publication Data

US 2003/0040405 A1 Feb. 27, 2003

(51) Int. Cl.[7] ..... A63B 22/02
(52) U.S. Cl. ..... 482/54
(58) Field of Search ..... 482/51, 54; 119/700, 119/703, 756

(56) References Cited

U.S. PATENT DOCUMENTS

| | | | | |
|---|---|---|---|---|
| 3,689,066 A | | 9/1972 | Hagen | 272/69 |
| 4,509,510 A | * | 4/1985 | Hook | 601/28 |
| 4,886,266 A | | 12/1989 | Trulaske | 272/69 |
| 4,984,810 A | | 1/1991 | Stearns et al. | 272/62 |
| 5,072,928 A | | 12/1991 | Stearns et al. | 272/69 |
| 5,184,988 A | | 2/1993 | Dunham | 482/54 |
| 5,279,528 A | | 1/1994 | Dalebout et al. | 482/54 |
| 5,336,144 A | | 8/1994 | Rodden | 482/54 |
| 5,382,207 A | | 1/1995 | Skowronski et al. | 482/54 |
| 5,441,468 A | | 8/1995 | Deckers et al. | 482/54 |
| 5,484,362 A | | 1/1996 | Skowronski et al. | 482/54 |
| 5,542,892 A | | 8/1996 | Buhler | 482/54 |
| 5,599,259 A | | 2/1997 | Skowronski et al. | 482/54 |
| 5,626,539 A | | 5/1997 | Piaget et al. | 482/54 |
| 5,649,882 A | | 7/1997 | Parikh et al. | 482/54 |
| 5,690,587 A | | 11/1997 | Gruenangerl | |
| 5,976,061 A | | 11/1999 | Moon et al. | 482/54 |
| 5,993,358 A | | 11/1999 | Gureghian et al. | |

OTHER PUBLICATIONS

DP Treadmills Brochure, Transport 9012 Treadmill, Copyright 1995 (showing red cushioned deck).
DP Brochure, Concourse™ 8.55 UB Treadmill 21–7088, On Information and Belief, available earlier than Aug. 27, 2000.
Nordic Track Brochure 6000 CS Trekker™, On Information and Belief, available at least as early as Mar., 2001.
ProForm Brochure, Trail Runner, Trekker™, Copyright 2000.

* cited by examiner

*Primary Examiner*—Stephen R. Crow
(74) *Attorney, Agent, or Firm*—Workman Nydegger

(57) ABSTRACT

A cushioned treadmill deck with a cushioning member coupled to the upper surface of a support deck is disclosed. The cushioning member cushions the impact to a user exercising on the treadmill. One cushioning member extends to the edges of the support deck such that the user can stand thereon. Examples of the cushioning member include a member having a plurality of cushioning layers, each having different cushioning properties, and a member having a cushioning layer and a protective layer.

25 Claims, 4 Drawing Sheets

TREADMILL DECK WITH CUSHIONED SIDES

BACKGROUND OF THE INVENTION

1. The Field of the Invention

The present invention relates to treadmills and treadmill decks, and more specifically to treadmills having cushioned treadmill decks.

2. Present State of the Art

Treadmills have become increasingly popular in recent years as exercise equipment. Treadmills are commonly used for either running or walking indoors at home, at the office, at commercial exercise establishments and at physical rehabilitation centers. Most exercise treadmills include a treadbase with an elongated, support deck. First and second rollers are typically mounted on opposite ends of the support deck. An endless belt is mounted for travel about the rollers. The belt is generally flexible and unable to support the weight of a user as the user contacts the belt. The support deck is disposed between the upper and lower portions of the belt, and commonly supports the belt and the weight of the user as the user ambulates (e.g., walks or runs) on the treadmill. The support deck is commonly made of a rigid material (e.g., wood). In modern treadmills, a motor controls the belt and causes the belt to move at varying speeds about the rollers. As the user ambulates on the belt, the belt is pressed against the underlying support deck, which supports the user during ambulation.

Due to the rigid support of certain treadmill decks, the shock of the user's step on the belt can be reflected back into the user's foot, ankle, knee and other joints in a similar manner as the reactive forces imposed by a paved surface. Because rigid decks reflect the shock from the user's step back to the user's joints, methods for cushioning treadmills have become popular. A cushioned treadmill absorbs some of the shock of the user's step, thus softening the impact on the user's foot and joints and increasing the enjoyment of the user.

Thus, some type of cushioning mechanism is advantageous. However, typical forms of cushioning require additional assembly and parts and require a frame structure in which to incorporate the desired cushioning method. One attempt that has been made to cushion the impact felt by the treadmill user is to place a cushion between the belt and the deck, such as featured in DP Transport 9012 Treadmills. However, one problem associated with prior cushioning attempts is that such treadmills fail to provide the maximum amount of cushioning that can be experienced by a user ambulating on the treadmill deck.

What is needed is an improved cushioned treadmill which is efficient to manufacture, enjoyable to the user, provides the maximum amount of cushioning to the entire treadmill deck, provides cushioning configured to resist wear, and has a pleasing aesthetic appearance.

One problem associated with providing such cushioning is that different treadmill users have different weights. Furthermore, different amounts of cushioning may be required when the user is standing the treadmill versus the user running on the treadmill. What is therefore also needed is a method for providing a universal amount of cushioning on a treadmill that will cushion a lightweight individual, a heavier individual, a person standing on the treadmill and a person running on the treadmill.

OBJECTS AND BRIEF SUMMARY OF THE INVENTION

It is, therefore, an object of the present invention to provide a cushioned treadmill that is inexpensive and efficient to manufacture.

It is another object of the present invention to provide a cushioned treadmill that is enjoyable for the user.

It is another object of the present invention to provide a cushioned treadmill that provides the maximum amount of cushioning to the entire treadmill deck.

It is another object of the invention to provide a cushioned treadmill having cushioned sides such that a user exercising on the treadmill can place the exercisers feet on the cushioned sides of the treadmill.

It is another object of the present invention to provide a cushioned treadmill that utilizes cushioning configured to resist wear.

It is a further object of the present invention to provide a cushioned treadmill that has a pleasing aesthetic appearance.

It is a further object of the present invention to provide a cushioned treadmill that does not form significant impressions therein when ambulated upon by a user.

It is a further object of the invention to provide cushioning for treadmill users having different weights.

It is a further object of the invention to provide different amounts of cushioning for users who are standing on a treadmill or running on the treadmill.

It is a further object of the invention to provide a system and method for providing a universal amount of cushioning on a treadmill that will cushion both the lightweight individual, the heavier individual, the person standing on the treadmill and the person running on the treadmill.

To achieve the foregoing objects, and in accordance with the invention as embodied and broadly described herein, a treadmill having a cushioning member on the treadmill support deck is provided. The cushioning member is configured to reside on a support deck below the belt, thereby forming a cushioned treadmill deck.

As a major advantage in the art, in one embodiment, a cushioning member extends from a central portion of the deck (under the belt) to at least one edge of the deck, and preferably from under the deck to each of the opposing edges of the deck. The cushion provides cushioning across the entire width of the treadmill deck (or even beyond the edges to cushion/decorate the sides of the deck and/or frame). At least one embodiment of the invention provides a universal amount of cushioning on a treadmill that will cushion a lightweight individual, a heavier individual, a person standing on the treadmill and a person running on the treadmill. By placing the cushioning member on the support deck, the treadmill deck may have a pleasing aesthetic appearance to the user. As another advantage, in at least one embodiment, by placing the cushioning member on the support deck, the cushioning member is not worn by rotating about the rollers.

In addition, in one embodiment, no side stepping platforms (also referred to as "rails") are provided that cover the deck or the cushioning member. This can be advantageous, as opposed to prior art designs. Thus, the user can step on the sides of the treadmill and experience the comfortable, cushioned sides, rather than impacting a less cushioned structure, such as the deck or a side stepping platform.

However, in another embodiment, one or more partial side stepping platforms are provided that partially cover the sides of the deck or the cushioning member, but do not cover the entire side portions of the cushioning member, thereby leaving a portion of the cushioning member remaining uncovered, such that a user can place the user's feet on the cushioned, non-platformed portion or on the stepping platforms, as desired.

One cushioning member has a cushioning layer, comprising, e.g., foam, and a protective layer, comprising, e.g., a woven fabric material. The protective layer protects the cushioning layer. A thin slick friction reducing layer, comprising, e.g., MYLAR can be mounted on top of the protective layer to reduce friction between the belt and the protective layer of the cushioning member.

In one embodiment, the cushioning member of the present invention comprises (i) first and second cushioning layers having different cushioning properties, (ii) a protective layer thereon, and (iii) a friction reducing layer on the top of the protective layer. The cushioning layers may have different properties, i.e., different levels of softness, such that one layer provides cushioning for one condition while another layer provides cushioning for another condition. For example, the upper layer may cushion a light individual or a standing individual, while the lower layer may cushion a heavier individual or a running individual. In one embodiment, the upper layer comprises a soft foam material, while the lower layer comprises a semi-soft foam material. A variety of different options are available, however, for cushioning the user, as will be discussed herein. The cushioning member may also be designed such that a layer prevents the formation of a significant depression in the cushioning member, thereby assisting the motor in turning the belt.

One treadmill of the present invention comprises a treadbase coupled to a base. The treadbase comprises a rigid support deck with front and rear rollers coupled to the support deck and having an endless belt trained about the rollers. The cushioning member is coupled to the upper surface of the support deck. The cushioning member extends from the center of the support deck beyond the edges of the belt to the edges of the deck, so as to cushion the impact of the user exercising on the belt and the impact of the user standing or stepping on the sides of the deck.

Extending the cushioning member beyond the edges of the belt also makes the cushioning member readily visible to the user exercising on the belt and gives the treadmill a more pleasing aesthetic appearance. Further, a potential user shopping for a treadmill views that the cushioning properties throughout the surface of the treadmill deck are present.

As mentioned, the cushioning member may comprise several different layers. Placing a protective layer on the surface of the cushioning member protects the lower layers from damage. In addition, by forming a softer top layer and a semi-soft lower cushioning layer, the soft layer cushions a user having one weight while the semi-soft lower layer cushions a user having a heavier weight.

Furthermore, the use of a semi-soft or rigid layer may prevent or at least ameliorate (i) increased work by the motor; and/or (ii) drag felt by the user as the user's feet contact the belt, compress the cushioning member, and slide backwards with the belt while performing exercise on the treadmill. Otherwise, more power may be required by the motor to drive the belt.

Further, placing a slick friction-reducing layer as the uppermost layer of the cushioning member, which contacts the belt when a user exercises thereon, minimizes friction between the belt and the cushioning member when the belt contacts the cushioning member. Minimizing the friction between the belt and the cushioning member prolongs the useful life of the cushioning member, decreases work exerted by the motor and further decreases drag experienced by the user.

While a variety of different materials may be used for the cushioning layers of the cushioning member, in one embodiment, the cushioning member comprises a plurality of layers of foam, each having a different cushioning property. For example, different kinds of foam may be employed, or different densities or thickness (or both) of foam may be employed to achieve a deck having cushioning layers having differing amounts of softness. Optionally, one or more non-foam materials are employed for one or more cushioning layers.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
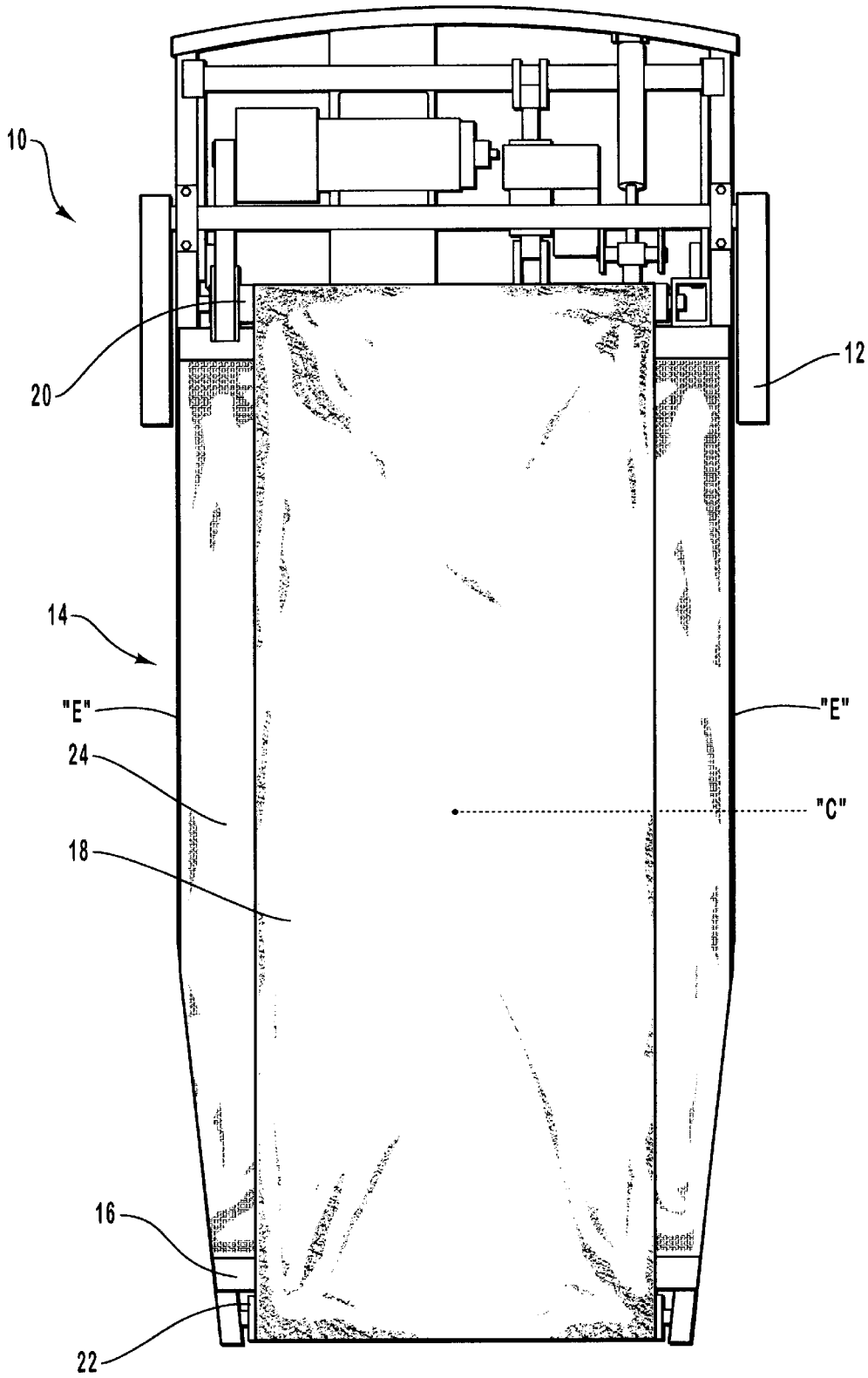
FIG. 1 illustrates a view of one embodiment of a cushioned treadmill of the present invention having a cushioning member that extends from the center of the treadmill deck to opposing side edges of the treadmill deck, allowing the user to stand on the cushioning portions on the sides of the deck.
Figure 2:
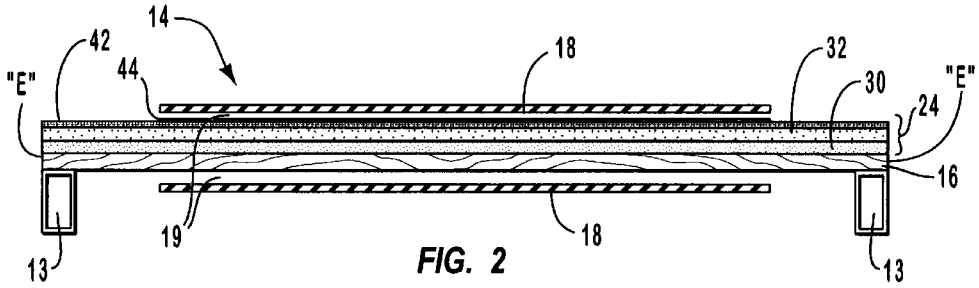
FIG. 2 illustrates a cross-sectional view of the embodiment of FIG. 1, featuring a cushioning member comprising: (i) first and second cushioning layers to cushion the impact of the user, (ii) a protective layer, and (iii) a friction reducing layer.

The present invention relates to cushioned treadmills with a cushioning member coupled to the upper surface of a support deck to cushion the impact of a user exercising on the treadmill. Depicted in FIGS. 1–2 is one embodiment of a treadmill 10 incorporating the features of one embodiment of the present invention. Cushioning member 24 provides cushioning and is resistant to wear by the user because it does not rotate about front and rear rollers 20 and 22 respectively.

As shown, cushioning member 24 extends from the center "C" of support deck 16 beyond the edges of belt 18 to the opposing edges "E" of the deck 16. Thus, the user can step or stand on the center or sides of the deck and experience a cushioned deck. Cushioning member 24 is readily visible to the user, thus providing the user confidence that the user's step on the deck will be cushioned.

As illustrated in FIG. 1, one embodiment of a treadmill 10 includes a base 12 and a treadbase 14 rotatably coupled to base 12 such that treadbase 14 may be rotated to a vertical storage position or to a horizontal operational position, as shown. Treadbase 14 can optionally be not rotatably affixed to base 12. It can be appreciated that various methods of attaching treadbase frame 13 to base 12 are also effective in carrying out the intended function thereof. It is further contemplated that treadmill 10 may comprise a support structure (not shown) comprising handrails that extend upwardly from base 12 and optionally connected to a console (not shown) at the upward end. It is also contemplated that a treadbase of the present invention may comprise a treadmill deck moveably coupled to a base.

With continued reference to FIG. 1, treadbase 14 comprises a rigid support deck 16 coupled to a front roller 20 and a rear roller 22. An endless belt 18 is trained about front roller 20 and rear roller 22 such that belt 18 has an upwardly exposed exercise section upon which the user exercises. Cushioning member 24 is coupled to the upper surface of support deck 16, extending from the center "C" of support deck 16 to the outer edges "E" thereof. The cushioning member of the present invention (e.g. cushioning member 24) may comprise one or more layers, as will be discussed hereafter. Cushioning member 24 is positioned between belt 18 and deck 16 such that cushioning member 24 cushions the impact of the user exercising on belt 18 and cushions a user standing on the sides of the deck. Cushioning member 24 extends from the center "C" of support deck 16 to the side edges "E" thereof, and is thus readily visible and has a pleasing aesthetic appearance to the user.

FIG. 2 depicts a cross section of the embodiment of FIG. 1. Treadbase 14 comprises a treadbase frame 13, rigid support deck 16 (e.g., comprising wood) mounted on treadbase frame 13, a cushioning member 24 coupled to the upper surface of support deck 16, and an endless belt 18 mounted on opposite rollers. Spaces 19 exist between belt 18 and support deck 16 and between belt 18 and cushioning member 24. Cushioning member 24 extends beyond the edges of belt 18 to the edges "E" of support deck 16.

Cushioning member 24 comprises a first, lower cushioning layer 30 coupled to the upper surface of support deck 16, and a second cushioning layer 32 mounted on first cushioning layer 30. Second, upper cushioning layer 32 is made of a material that is soft (e.g., a foam material, such as EVA foam and/or neoprene or a similar material), while first, lower cushioning layer 30 comprises a material that provides cushioning, but is harder than upper layer 32, i.e., a semi-soft material (e.g., a foam material, such as EVA foam). Thus, the second, upper layer 32 is made from a material that is softer than the first, lower layer 30. The first, lower layer 30 comprises a semi-soft layer that is softer than rigid support deck 16 (which may be a wooden material, for example), but is harder than soft upper layer 32.

The soft upper layer 32 may be configured to cushion a lighter weight person or a person standing on the treadmill, while the semi-soft lower layer 30 may be configured to cushion a heavier person or a person running on the treadmill, for example. In light of its increased hardness, the semi-soft layer 30 can also at least partially prevent (i) increased work by the motor; and/or (ii) drag felt by the user as the user's feet contact the belt, compress the cushioning member, and slide backwards with the belt while performing exercise on the treadmill.

In one embodiment the lower, first cushioning layer is more dense than the upper, second cushioning layer in order to achieve the desired difference in softness. In another embodiment of the invention, different materials are employed in the different layers to create the difference in softness. In another embodiment, different thicknesses of materials are employed to create the difference in softness. The upper material can provide cushioning to a lighter weight user or a standing user, while the lower material provides cushioning to a heavier or running user.

A protective layer 42 (comprising e.g., a woven fabric) is also shown coupled to the upper surface of the second, upper cushioning layer 32. The protective layer 42 serves to protect the cushioning layers, to shed dirt, and to provide a pleasing aesthetic appearance. Cushioning member 24 further comprises a slick, friction reducing layer 44 (e.g, comprising MYLAR). Layer 44 reduces friction between the belt and the protective layer. By reducing friction between belt 18 and cushioning member 24, the slick second layer 44 reduces wear on protective layer 42 and decreases drag by the belt against the cushioning member 24 during use.

Figure 3:
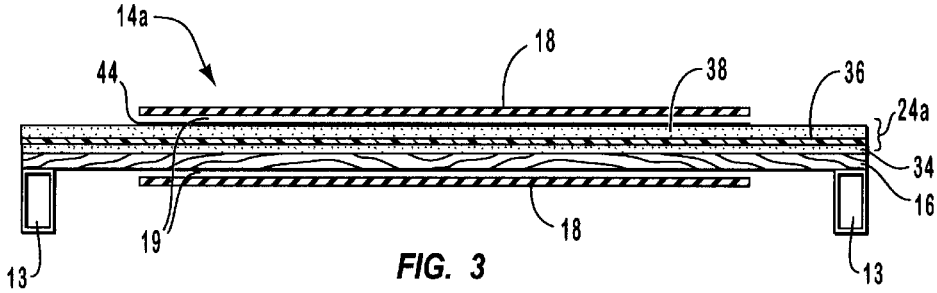
FIG. 3 illustrates a cross-sectional view of another embodiment of a cushioned treadbase featuring first and third cushioning layers to absorb the impact of the user, and a second rigid layer between the first and third cushioning layers to prevent the formation of significant depressions in the cushioning member.

FIG. 3 depicts a cross section of another embodiment of treadbase **14*a*. Treadbase 14*a* comprises a treadbase frame 13, rigid support deck 16 mounted on treadbase frame 13, a cushioning member 24*a* coupled to the upper surface of support deck 16, and an endless belt 18 mounted on opposite rollers. Spaces 19 exist between belt 18 and support deck 16 and between belt 18 and cushioning member 24*a***.

Cushioning member **24*a* extends beyond the edges of belt 18 to the edges of support deck 16. Cushioning member 24*a* comprises a first, cushioning layer 34 coupled to the upper surface of support deck 16, a second, rigid layer 36 mounted on first cushioning layer 34, and a third, cushioning layer 38 mounted on second, rigid layer 36. First, cushioning layer 34 is made from a soft material (e.g., a foam material). Second, rigid layer 36 is made a rigid material (e.g., ABS plastic). Third, cushioning layer 38 is made from a soft material (e.g., a foam material), either the same as or different from the material of cushioning layer 34. Cushioning member 24*c* further comprises a friction reducing layer 44**.

The use of the rigid layer 36 may prevent or at least decrease (i) increased work by the motor; and/or (ii) drag felt by the user as the user's feet contact the belt, compress the cushioning member, and slide backwards with the belt while performing exercise on the treadmill. In yet another embodiment, one or both of layers 34 and 38 (e.g., layer 34) comprise a semisoft material.

Figure 4:
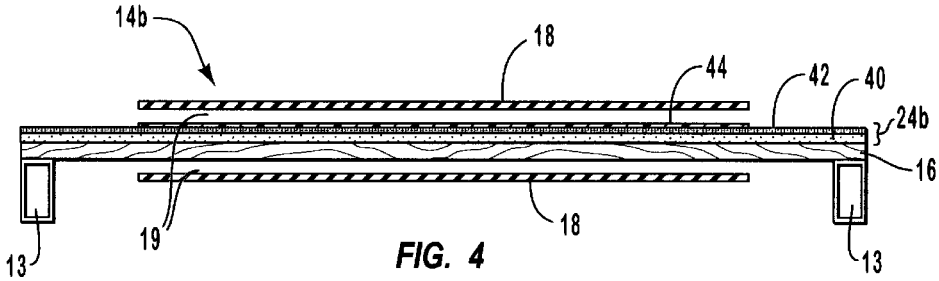
FIG. 4 illustrates a cross-sectional view of another embodiment of a cushioned treadbase featuring a cushioning member comprising: (i) a friction reducing layer to reduce the friction between the cushioning member and the belt, (ii) a fabric protective layer; and (iii) an underlying cushioning layer.

FIG. 4 depicts a cross sectional view of another embodiment of treadbase 14*b*. Treadbase 14*b* comprises a treadbase frame 13, rigid support deck 16 mounted on treadbase frame 13, a cushioning member 24*b* coupled to the upper surface of support deck 16, and an endless belt 18 mounted on opposite rollers. Spaces 19 exist between belt 18 and support deck 16 and between belt 18 and cushioning member 24*b*.

Cushioning member 24*b* extends beyond the edges of belt 18 to the edges of support deck 16. Cushioning member 24*b* comprises a soft cushioning layer 40 (e.g., EVA foam) coupled to the upper surface of support deck 16, a protective layer 42 (e.g., woven fabric) mounted on cushioning layer 40, and a friction reducing layer 44 (e.g., MYLAR) mounted on protective layer 42. Layer 44 decreases drag by the belt on cushioning member 24*b*, reducing wear on protective layer 42 and decreasing drag felt by the user. Friction reducing layer 44 does not extend to the edges of support deck 16 so that the user will not slip on layer 44 if the user steps off to the side of belt 18 directly onto cushioning member 24*b*.

Figure 5:
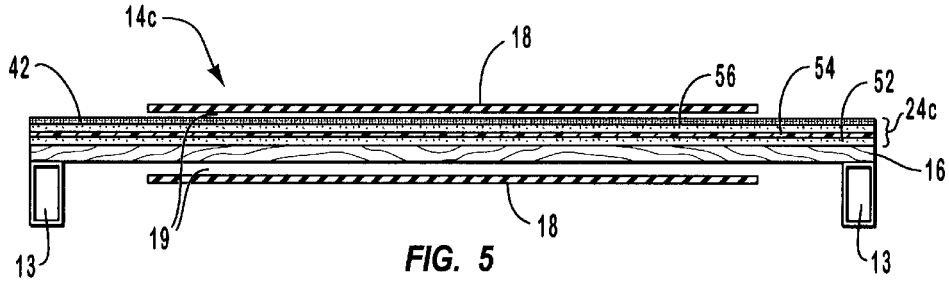
FIG. 5 illustrates a cross-sectional view of another embodiment of a cushioned treadbase.

FIG. 5 depicts a cross section of another embodiment of treadbase 14*c*. Treadbase 14*c* comprises a treadbase frame 13, rigid support deck 16 mounted on treadbase frame 13, a cushioning member 24*c* coupled to the upper surface of support deck 16, and an endless belt 18*c* mounted on opposite rollers. Spaces 19 exist between belt 18 and support deck 16 and between belt 18*c* and cushioning member 24*c*.

Cushioning member 24*c* extends beyond the edges of belt 18 to the edges of support deck 16. Cushioning member 24*c* comprises a first soft cushioning layer 52 (e.g., foam) coupled to the upper surface of support deck 16, a second rigid layer 54 (e.g., ABS plastic) mounted on first, cushioning layer 52, and a third, soft cushioning layer 56 (e.g., foam) mounted on second layer 54. Second layer 52 comprises a rigid material that lessens the drag felt by the motor/user as the user's feet compress cushioning member 24*c* and slide backward with belt 18 during use. The rigid layer 52 may also prevent significant depressions from forming in cushioning member 24*c*.

An additional protective layer 42 may also be employed. Such a layer may have certain friction reducing properties on the upper surface thereof, for example. For example, a fabric used for layer 59 may be a slick fabric that reduces the friction between the belt and the cushioning member.

Figure 6:
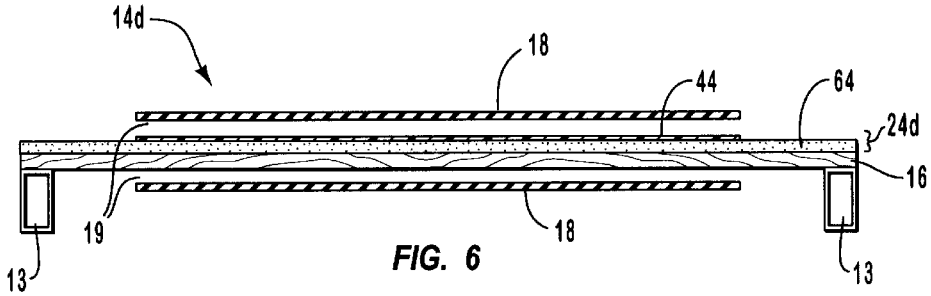
FIG. 6 illustrates a cross-sectional view of another embodiment of a cushioned treadbase featuring a soft cushioning layer and a slick layer.

FIG. 6 depicts a cross section of another embodiment of treadbase 14*d*. Treadbase 14*d* comprises a treadbase frame 13, rigid support deck 16 mounted on treadbase frame 13, a cushioning member 24*d* coupled to the upper surface of support deck 16, and an endless belt 18 mounted on opposite rollers. Spaces 19 exist between belt 18 and support deck 16 and between belt 18 and cushioning member 24*d*.

Cushioning member 24*d* extends beyond the edges of belt 18 to the edges of support deck 16. Cushioning member 24*d* comprises a cushioning layer 64 coupled to the upper surface of support deck 16, and a friction reducing layer 44 mounted on cushioning layer 64. Cushioning layer 64 is made of a soft material.

Figure 7:
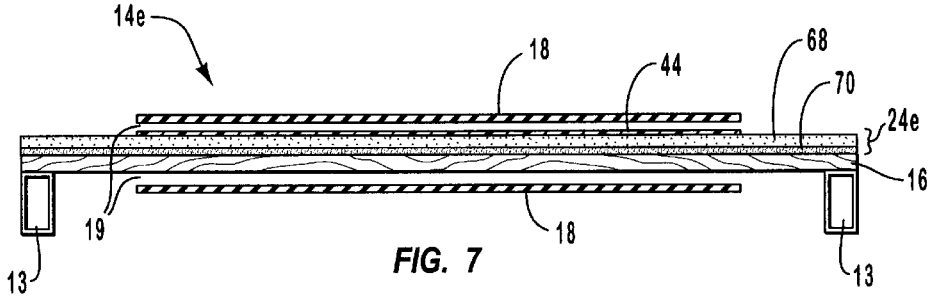
FIG. 7 illustrates a cross-sectional view of another embodiment of a cushioned treadbase featuring a soft cushioning layer, a semi-soft cushioning layer, and a slick layer.

FIG. 7 depicts a cross section of another embodiment of treadbase 14*e*. Treadbase 14*e* comprises a treadbase frame 13, rigid support deck 16 mounted on treadbase frame 13, a cushioning member 24*e* coupled to the upper surface of support deck 16, and an endless belt 18 mounted on opposite rollers. Spaces 19 exist between belt 18 and support deck 16 and between belt 18 and cushioning member 24*e*.

Cushioning member 24*e* extends beyond the edges of belt 18 to the edges of support deck 16. Cushioning member 24*e* comprises a first, cushioning layer 70 coupled to the upper surface of support deck 16, a second, cushioning layer 68 mounted on first, cushioning layer 70, and a third, friction reducing layer 44 mounted on second, cushioning layer 68. First, cushioning layer 70 is made of a semi-soft material. Second, cushioning layer 68 is made of a soft material. Third layer 44 is made of a friction-reducing material to reduce the friction between belt 18 and cushioning member 24*e*. The semi-soft, first cushioning layer 70 is less susceptible than the soft second cushioning layer 68 to forming significant depressions therein and decreases wear on the belt roller motor by decreasing drag.

Figure 8:
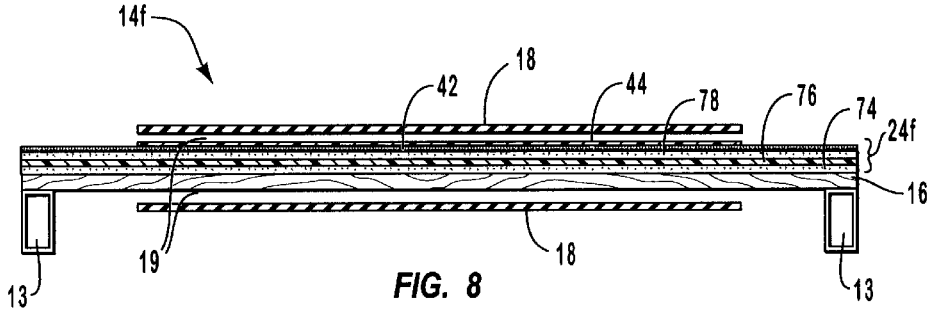
FIG. 8 illustrates a cross-sectional view of another embodiment of a cushioned treadbase featuring two soft cushioning layers, a rigid layer, a fabric layer, and a slick layer.

FIG. 8 depicts a cross section of another embodiment of treadbase 14*f*. Treadbase 14*f* comprises a treadbase frame 13, rigid support deck 16 mounted on treadbase frame 13, a cushioning member 24*f* coupled to the upper surface of support deck 16, and an endless belt 18 mounted on opposite rollers. Spaces 19 exist between belt 18 and support deck 16 and between belt 18 and cushioning member 24*f*.

Cushioning member 24*f* extends beyond the edges of belt 18 to the edges of support deck 16. Cushioning member 24*f* comprises a first, soft cushioning layer 74 (e.g., foam) coupled to the upper surface of support deck 16, a second, rigid layer 76 (e.g., ABS plastic) mounted on first, cushioning layer 74, a third, soft cushioning layer 78 (e.g., foam) mounted on second layer 76, and a protective layer 42 mounted on third, cushioning layer 78. First, cushioning layer 74 is made of a soft material. Second layer 76 is made of a rigid material that can prevent significant depressions from forming in cushioning member 24*f* and decreases drag felt by the motor and the user during use. Third, cushioning layer 78 is made of either the same or a different soft material as first, cushioning layer 74.

Placing a rigid layer 76 between soft cushioning layers 74 and 78 serves to prevent the formation of significant depressions made by the user exercising on the treadmill. Cushioning member 24*f* may further comprise friction reducing layer 44.

Figure 9:
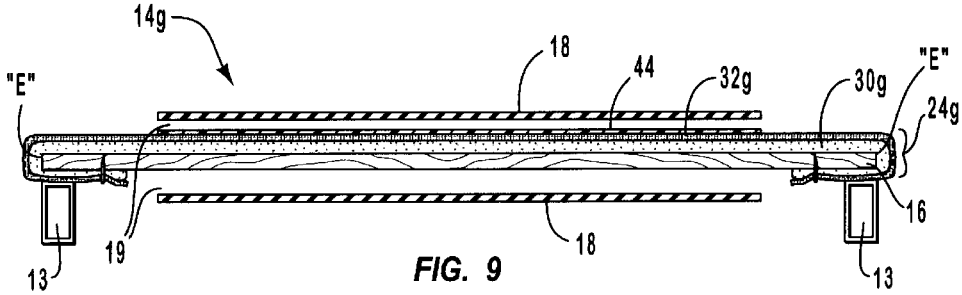
FIG. 9 illustrates a cross-sectional view of another embodiment of a cushioned treadbase wherein the cushioning member extends over the sides of the support deck to thereby cushion the sides of the support deck.

FIG. 9 depicts a cross section of another embodiment of a treadbase 14*g* of the present invention. Treadbase 14*g* comprises a treadbase frame 13, rigid support deck 16 mounted on treadbase frame 13, a cushioning member 24*g* mounted on the upper surface of support deck 16 and attached (e.g., stapled) at opposing ends thereof to the lower surface of the support deck to thereby cushion the sides of the deck 16, and an endless belt 18 mounted on opposite rollers. Spaces 19 exist between belt 18 and support deck 16 and between belt 18 and cushioning member 24*g*.

Cushioning member 24*g* extends from the center of the support deck 16 past the edges of belt 18 and further extends over the edges "E" of support deck 16. Member 24*g* then extends alongside edges "E", then under the edges "E" and couples to the underside of the deck, as shown.

Cushioning member 24*g* comprises a first, soft cushioning layer 30*g* coupled to the support deck 16, a protective layer 32*g* mounted on cushioning layer 30, and a friction reducing layer 44 mounted on protective layer 32*g*. Cushioning member 24*g* thus cushions the treadmill deck.

Furthermore, cushioning member 24*g* may comprise a variety of different layers, such as those described above with reference to FIGS. 2–8, each of which may be employed in an embodiment in which the cushioning member extends over the sides of the treadmill deck, as shown in FIG. 9. For example, in one embodiment member 24*g* comprises a first layer on the support deck, a second layer on the first layer, a protective layer on the first layer, wherein the second layer is softer than the first layer. Friction reducing layer 44 may also be employed. In yet another embodiment, an adhesive is employed to connect cushioning member 24*g* to the underside of deck 16.

The embodiment of FIG. 9 features additional cushioning to the sides of the treadmill. However, the embodiment is also advantageous because an additional decorative part is not required to decorate an unfinished edge of the deck. Thus, by wrapping the cushioning member 24*g* around the side edges, the wrapped portion of the cushioning member acts as a decorative member over an unfinished side edge of the deck, thereby enhancing the aesthetic appearance of the treadmill.

The soft cushioning layers of the cushioning members described above are softer than the rigid deck 16. The "semi-soft" cushioning layers described above are softer than the deck 16, but harder than the "soft" cushioning layers. The rigid layers described above can be non compressible or essentially non compressible, yet flex when gripped at the ends and moved, such as when a thin, hard plastic is employed, for example.

By way of example, the soft and/or semi-soft cushioning portions articulated above can be made of neoprene and/or EVA (i.e., ethylene vinyl acetate) foam or similar materials. Examples of materials used to make the rigid layers of cushioning members are high-impact polystyrene, ABS plastic (i.e., acrylonitrile butadiene styrene), polypropylene, various phenolic materials, and wood. As mentioned, the difference between the soft and semi-soft layers may optionally be achieved through differences in density of the same material, for example. The layers of the cushioning member of the present invention may be selected from the group consisting of (i) discrete layers; and (ii) integral layers.

Examples of materials used to make the fabric layers of cushioning members are polyester and nylon. Examples of a friction-reducing material include a thin sheet of polyester, such as MYLAR and/or other materials. The cushioning and protective layers of the cushioning members may all be adhered to one another and/or to deck 16 through a variety of attachment methods, such as through the use of one or more adhesives. Other methods, may optionally be employed.

For example, the upper and lower cushioning layers (e.g., FIG. 2) may be attached to each other through adhesion. Similarly, upper and lower cushioning layers may be attached on opposite portions of a rigid layer (e.g., FIG. 8) through adhesion. In either embodiment, a protective layer may be coupled to the uppermost cushioning layer through adhesion, for example, while the lower cushioning layer is coupled to the deck through adhesion, also by way of example. Alternatively, one or more layers, e.g., the friction reducing layer may be mechanically attached to the deck and/or protective layer, such as by stapling.

In one embodiment: (i) the protective layer is coupled to the cushioning layer(s) through adhesion; (ii) the cushioning layer(s) is coupled to the support deck through adhesion; and (iii) the friction reducing layer, e.g., layer 44 is maintained on top of the protective layer by having front and rear portions thereof wrap around respective front and rear portions of the support deck and stapled to respective opposing underside portions of the deck.

The fabric layers employed in the protective layers discussed above may be a woven fabric material, for example, but may alternatively comprise a variety of different fabric types such as looped pile, cut pile, and/or other types of fabric. The fabric protective layer helps to prevent wear by the belt or feet of the user on the cushioning member and has a pleasing aesthetic appearance. The fabric also tends to shed dirt and appear cleaner.

The protective layer is optionally, the skin portion of a manufactured foam cushion member. Thus, in one embodiment, the cushioning member comprises a foam material, wherein the protective layer comprises a skin layer of the foam and the cushioning layer comprises the foam material below the protective skin layer and/or surrounded by the protective skin layer.

While a variety of different sizes and dimensions may be employed in the present invention, in one embodiment, the friction reducing layer, e.g., MYLAR is about 0.007 inch in thickness, while the first foam layer, e.g., layer 40 (FIG. 4) is approximately 0.18 inch in thickness. In the embodiment comprising first and second foam layers, e.g., as in FIG. 2, each foam layer may be approximately 0.18 inch in thickness, for example. However, these amounts are provided by way of example only and a variety of different thicknesses may be employed depending upon the desired application.

Thus, as mentioned, in one embodiment, the top cushioning layer comprises a soft foam while the bottom cushioning layer comprises a harder, semi-soft foam. The soft foam may be configured to cushion a lighter weight person, or a standing invidividual, while the harder foam cushions a heavier, or running individual. In other words, the use of multiple foam layers provide a more universal range of use. The foam layers may be discrete layers, that are adhered to each other through the use of an adhesive, or may be integral layers having different cushioning properities.

The protective layer may comprise a variety of different materials, such as a fabric or an outer skin portion of a manufactured foam member. The protective layer may be discrete from or integral with another cushioning layer, for example. The MYLAR layer (and/or the belt) can be lubricated, e.g., with an oil, to provide additional friction reduction. It is also contemplated that isolators (not shown) may be placed between treadbase frame 13 and support deck 16 to give an additional level of cushioning to the treadmill.

Figure 10:
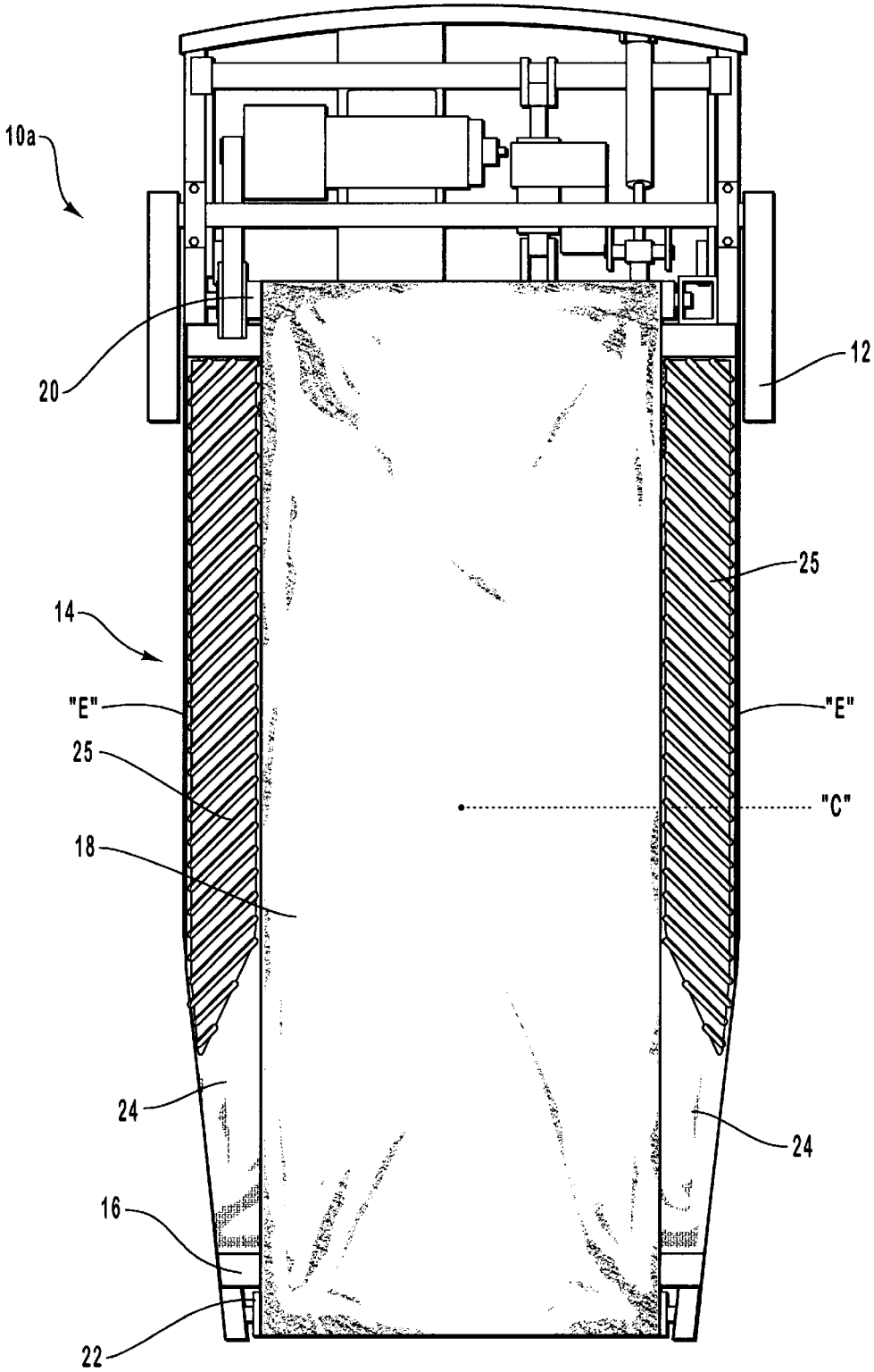
FIG. 10 illustrates the top view of a treadmill of the present invention having side stepping platforms that cover the front side portions of the deck, but do not cover the entire side portions of the deck, thereby leaving a rear portion of the deck remaining uncovered, such that a user can place the user's feet on the rear, cushioned, non-platformed portion or on the stepping platforms in the front, as desired.

An optional embodiment is shown in FIG. 10. As shown, it is further contemplated that treadbase 14 may comprise partial side stepping platforms 25 (not shown) on one or both sides of treadbase 14 such that the user of treadmill 10 can step off of belt 18 onto one or both of the partial side stepping platforms 25 at a front portion or step onto the cushioning member 24 at a rear portion. This embodiment allows the user to employ partial side platforms 25 (which may comprise a rigid or semi-rigid material) if desired, yet also have a portion of the treadmill that employs no such platform.

The treadbase 10*a* may have the same configuration of cushioning members as discussed with respect to FIGS. 2–9, such as the cushioning member 24 featured in FIG. 2 or the cushioning member 24*b* featured in FIG. 4, or the cushioniong member 24*g*, for example.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cushioned treadmill deck for use in a treadmill system wherein a user exercises on an endless belt rotating on rollers about the deck, the treadmill deck designed to cushion the impact of the user on the endless belt, the treadmill deck comprising:

a support deck; and means for cushioning contact on the support deck, wherein the means for cushioning extends from the center of the support deck to at least one means for cushioning without standing on the endless belt of the support deck such that a user can stand on the edge and experience cushioning on the edge of the support deck.

2. A treadmill deck as recited in claim 1, wherein the means for cushioning comprises a cushioning member mounted on the support deck.

3. A treadmill deck as recited in claim 2, wherein the cushioning member comprises a cushioning layer coupled to the upper surface of the support deck and a protective layer coupled to the upper surface of the cushioning layer.

4. A treadmill deck as recited in claim 3, wherein the protective layer comprises a fabric layer and the cushioning layer comprises a foam layer.

5. A treadmill deck as recited in claim 3, further comprising a friction reducing layer coupled to an upper surface of the protective layer so as to reduce friction created between the means for cushioning and the belt as the user exercises thereon.

6. A treadmill deck as recited in claim 2, wherein the cushioning member has a plurality of layers, each layer having different cushioning properties.

7. A treadmill deck as recited in claim 6, wherein the cushioning member has first and second cushioning layers, the first layer being coupled to the upper surface of the support deck and the second layer being coupled to the upper surface of the first layer.

8. A treadmill deck as recited in claim 7, wherein the second cushioning layer is softer than the first layer.

9. A treadmnill deck as recited in claim 8, wherein the support deck comprises wood, the first cushioning layer comprises a foam material, and the second cushioning layer comprises a foam material.

10. A treadmill deck as recited in claim 1, wherein the deck further comprises first and second partial side stepping platforms that cover a portion of the sides of the treadmill deck, extending to first and second edges thereof, yet do not cover the entire sides of the treadmill deck.

11. A cushioned treadmill deck for use in a treadmill system wherein a user exercises on an endless belt rotating on rollers about the deck, the treadmill deck designed to cushion the impact of the user on the endless belt, the treadmill deck comprising:

a support deck; and a cushioning member configured to cushion contact on the support deck, wherein the cushioning member extends from the center of the support deck to at least one cushioning member without standing on the endless belt of the support deck such that a user can stand on the edge and experience cushioning on the edge of the support deck.

12. A treadmill deck as recited in claim 11, wherein the cushioning member comprises a cushioning layer coupled to the upper surface of the support deck and a protective layer coupled to the upper surface of the cushioning layer.

13. A treadmill deck as recited in claim 12, wherein the protective layer comprises a fabric layer and the cushioning layer comprises a foam layer.

14. A treadmill deck as recited in claim 12, further comprising a friction reducing layer coupled to an upper surface of the protective layer so as to reduce friction created between the means for cushioning and the belt as the user exercises thereon.

15. A treadmill deck as recited in claim 11, wherein the cushioning member has a plurality of layers, each layer having different cushioning properties.

16. A treadmill deck as recited in claim 15, wherein the cushioning member has first and second cushioning layers, the first layer being coupled to the upper surface of the support deck and the second layer being coupled to the upper surface of the first layer.

17. A treadmill deck as recited in claim 16, wherein the second layer is softer than the first layer.

18. A treadmill deck as recited in claim 11, wherein the cushioning member extends from the center of the deck to first and second edges of the treadmill deck, such that a user can stand on the edges and feel cushioning on the edges of the deck.

19. A treadmill as recited in claim 11, wherein the cushioning member extends over the edge of the deck.

20. A treadmill as recited in claim 11, wherein the cushioning member wraps around both edges of the deck and attaches to the bottom surface of the deck.

21. A treadmill deck as recited in claim 20, wherein the cushioning member is selected from the group consisting of: (A) a cushioning member comprising: (i) a cushioning layer and (ii) a protective layer coupled thereto; and (B) a cushioning member comprising (i) first and second cushioning layers, wherein the first layer is mounted on the deck and the second layer is mounted on the first layer and (ii) a protective layer mounted on the second layer.

22. A treadmill deck as recited in claim 11, wherein the deck further comprises first and second partial side stepping platforms that cover a front portion of the sides of the treadmill deck, extending to the side edges of the front portion of the deck, yet do not cover the rear side portions of the treadmill deck.

23. A cushioned treadmill deck for use in a treadmill system wherein a user exercises on an endless belt rotating on rollers about the deck, the treadmill deck designed to cushion the impact of the user on the endless belt, the treadmill deck comprising:

a support deck; and a cushioning member configured to cushion contact on the support deck, wherein the cushioning member comprises:

(i) a cushioning layer coupled to the support deck; wherein the cushioning layer extends from the center of the support deck to at least one edge of the support deck such that a user can stand on the cushioning layer but not on the endless belt and experience cushioning on the edge of the support deck; and (ii) a protective layer coupled to the cushioning layer.

24. A treadmill deck as recited in claim 23, wherein the protective layer comprises a fabric layer and the cushioning layer comprises a foam layer.

25. A treadmill deck as recited in claim 23, further comprising a friction reducing layer coupled to an upper surface of the protective layer so as to reduce friction created between the cushioning member and the belt as the user exercises thereon.

* * * * *

UNITED STATES PATENT AND TRADEMARK OFFICE

CERTIFICATE OF CORRECTION

PATENT NO. : 6,786,852 B2 
APPLICATION NO. : 09/940691
DATED : September 7, 2004
INVENTOR(S) : Watterson et al.

It is certified that error appears in the above-identified patent and that said Letters Patent is hereby corrected as shown below:

Column 1,
Line 57, after "standing" insert --on--

Column 6,
Line 57, before "a rigid material" insert --from--

Column 7,
Line 27, after "endless belt" change "18c" to --18--
Line 29, after "between belt" change "18c" to --18--

Column 11,
Line 10, change "means for cushioning without standing on the endless belt" to --edge--
Line 12, change "edge" to --means for cushioning without standing on the endless belt--
Line 39, change "treadmnill deck" to --treadmill deck--
Line 57, change "cushioning member without standing on the endless belt" to --edge--
Line 59, change "edge" to --cushioning member without standing on the endless belt--

Signed and Sealed this

Twenty-ninth Day of August, 2006

JON W. DUDAS
*Director of the United States Patent and Trademark Office*